United States Patent [19]

Remington et al.

[11] Patent Number: 4,495,540

[45] Date of Patent: Jan. 22, 1985

[54] ELECTRONIC LOCK

[75] Inventors: Richard C. Remington, Pompton Plains; Lonnie C. Bott, Wayne, both of N.J.

[73] Assignee: Presto Lock, Inc., Garfield, N.J.

[21] Appl. No.: 453,131

[22] Filed: Dec. 27, 1982

[51] Int. Cl.[3] ..... H01H 47/32

[52] U.S. Cl. ..... 361/172; 340/542; 340/825.31

[58] Field of Search ..... 361/171, 172; 340/825.31, 825.32, 542; 70/277, 278; 307/10 AT; 308/10, 187

[56] References Cited

U.S. PATENT DOCUMENTS

| | | | |
|---|---|---|---|
| 3,691,396 | 9/1972 | Hinrichs | 361/172 X |
| 3,751,718 | 8/1973 | Hanchett, Jr. | 70/278 X |
| 3,812,403 | 5/1974 | Gartner | 70/278 X |
| 3,885,408 | 5/1975 | Clark, Jr. | 70/278 |
| 3,893,073 | 7/1975 | Angello | 340/147 |
| 3,940,738 | 2/1976 | Teeters | 340/147 |
| 3,953,769 | 4/1976 | Sopko | 317/134 |
| 4,019,355 | 4/1977 | Germanton | 70/278 |
| 4,118,692 | 10/1978 | Fitchett | 340/542 |
| 4,139,864 | 2/1979 | Schulman | 358/188 |
| 4,148,092 | 4/1979 | Martin | 361/172 |
| 4,205,325 | 5/1980 | Haygood et al. | 340/147 |
| 4,206,491 | 6/1980 | Ligman et al. | 361/172 |
| 4,207,555 | 6/1980 | Trombly | 340/147 |
| 4,222,088 | 9/1980 | Burton | 361/172 |
| 4,232,354 | 11/1980 | Mueller et al. | 361/172 |

FOREIGN PATENT DOCUMENTS

| | | | |
|---|---|---|---|
| 2455317 | 11/1980 | France | 340/825.31 |

*Primary Examiner*—Reinhard J. Eisenzopf

*Attorney, Agent, or Firm*—Shapiro and Shapiro

[57] ABSTRACT

An electronic combination lock for luggage and the like comprises a microcomputer, a display having a plurality of display locations, and a plurality of push buttons, one being associated with each display location. Each push button advances its associated display location through a sequence of digits and enables selection of a desired digit for display. A displayed set of digits is compared with a stored predetermined set of digits, and a bistable electromagnetic latch is operated to open the lock when the sets of digits match. The electromagnetic latch comprises a magnetic member pivotally mounted for rotation between a pair of pole pieces, the magnetic member having first and second stable rotational positions at which each magnetic pole is adjacent to a different pole piece, and a pair of oppositely wound coils associated with the pole pieces and responsive to the momentary flow of electrical current therethrough for producing a magnetic flux that causes the magnetic member to rotate from one position to the other.

11 Claims, 5 Drawing Figures

ELECTRONIC LOCK

BACKGROUND OF THE INVENTION

This invention relates generally to electronic locks, and more particularly to electronic combination locks especially adapated for use on luggage and the like.

Mechanical, multiple dial combination locks are well known as locking devices on luggage cases and similar articles. In addition to providing security, they add a degree of attractiveness and distinctiveness to luggage and enhance its appeal. Although known combination locks perform satisfactorily, it is desirable to provide improved combination locks having greater flexibility in design, operation, function, and placement on the article on which they are used.

Electronic combination locks are well known for use at entrance ways of buildings and automobiles, for example, and they have a number of advantages over mechanical combination locks. However, a practical electronic combination lock for luggage must satisfy certain criteria. It must be small and compact, easy to operate, and, since it must be battery operated, it must have rather low power consumption. Moreover, since luggage is often stored for long periods of time, often in a locked condition, the lock must be designed so that the luggage can be opened should the battery go dead.

SUMMARY OF THE INVENTION

The invention provides an electronic lock which satisfies the above requirements and which affords certain other advantages.

Briefly stated, in one aspect, the invention provides an electronic lock comprising display means having a plurality of display locations, a plurality of push buttons, each push button being associated with a different location, means responsive to the actuation of a push button for displaying at the associated location a sequence of indicia and for enabling selection from the sequence of a selected indicium for display at the associated location, thereby enabling a selected set of indicia to be displayed, means for storing a predetermined set of indicia corresponding to the on-combination condition of the lock, means for comparing the displayed set of indicia with the stored predetermined set of indicia, and means responsive to the comparison for operating associated latch means for opening the lock when the sets of indicia match.

DESCRIPTION OF THE PREFERRED EMBODIMENT

Electronic locks in accordance with the invention are especially well adapted for use on luggage and the like, and will be described in that environment. However, as will be appreciated, this is illustrative of only one utility of the invention.

Figure 1:
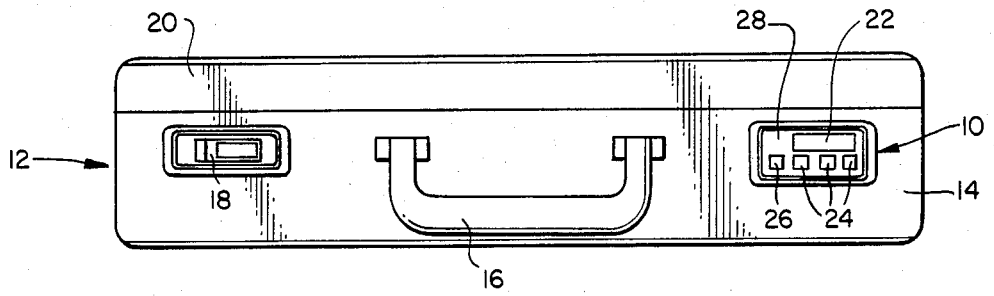
FIG. 1 is an elevational view illustrating an electronic lock in accordance with the invention on a luggage case.

FIG. 1 illustrates one manner in which an electronic lock 10 in accordance with the invention may be used on a luggage case 12. As shown, the electronic lock may be disposed on an exterior surface of a sidewall 14 of the luggage case on one side of a carrying handle 16, and a manually operable actuator 18 may be disposed on the sidewall on the opposite side of the handle. The actuator may be slideable and may be coupled to a latching mechanism (not illustrated) disposed on the interior surface of the sidewall. The latching mechanism may comprise, for example, spaced latch members slideably or pivotally mounted within the case on the sidewall and engageable with associated hasps disposed on the interior surface of the lid 20 of the case for holding the parts of the case together. The latches may be coupled to the actuator by one or more control members arranged to move the latches to unlatching position when the actuator is operated. As will be described in more detail shortly, the electronic lock includes means for controlling the operation of the latching mechanism, as by blocking the movement of the actuator or a control member when the lock is off combination (locked) and permitting such movement when the lock is on combination (unlocked). The precise arrangement of the latching mechanism and the precise manner in which it is controlled by the electronic lock are not important to the invention. It will become apparent that the electronic lock may be adapted readily to control different latching mechanisms.

As shown in FIG. 1 and as will be described in more detail shortly, the electronic lock is battery operated and may comprise a display 22 for displaying combination indicia, e.g., digits, and a plurality of push buttons 24, 26 for entering combinations and for controlling the lock, all disposed on a faceplate 28. In a preferred form as described herein, the electronic lock may be a three "dial" combination lock (although a greater or smaller number may also be used), wherein the display has three separate display locations for displaying a three-digit combination, each display location being associated with one of the push buttons 24. (Push button 26 is used for controlling the operating mode and for opening the lock, as will be described shortly.) Depressing a push button 24 causes its associated "dial" to "spin" and to successively display a predetermined sequence of combination indicia, e.g., the digits 0–9. The push buttons preferably produce an audible click when depressed, and may be arranged so that each time a push button is depressed, its associated display location advances to the next digit of the sequence. If the push button is held depressed, the display location may automatically advance through the sequence of digits, momentarily stopping on each digit. When a desired digit appears on the display, releasing the push button causes the digit to remain displayed.

The electronic lock preferably has different operating modes, which include a time mode and a combination mode. Preferably, the electronic lock is arranged so that time of day normally is displayed on display 22. This is the time mode. Push button 26 is a lock/mode function push button which enables selection of the combination mode, wherein combination digits entered by push buttons 24 are displayed on display 22. Upon the lock being set on-combination, depressing push button 26 causes the lock to unlock, and the display automatically reverts to the time mode. This is an automatic display scramble feature that enables the lock to be left on-combination while preventing the combination from being observed by unauthorized persons.

Figure 2:
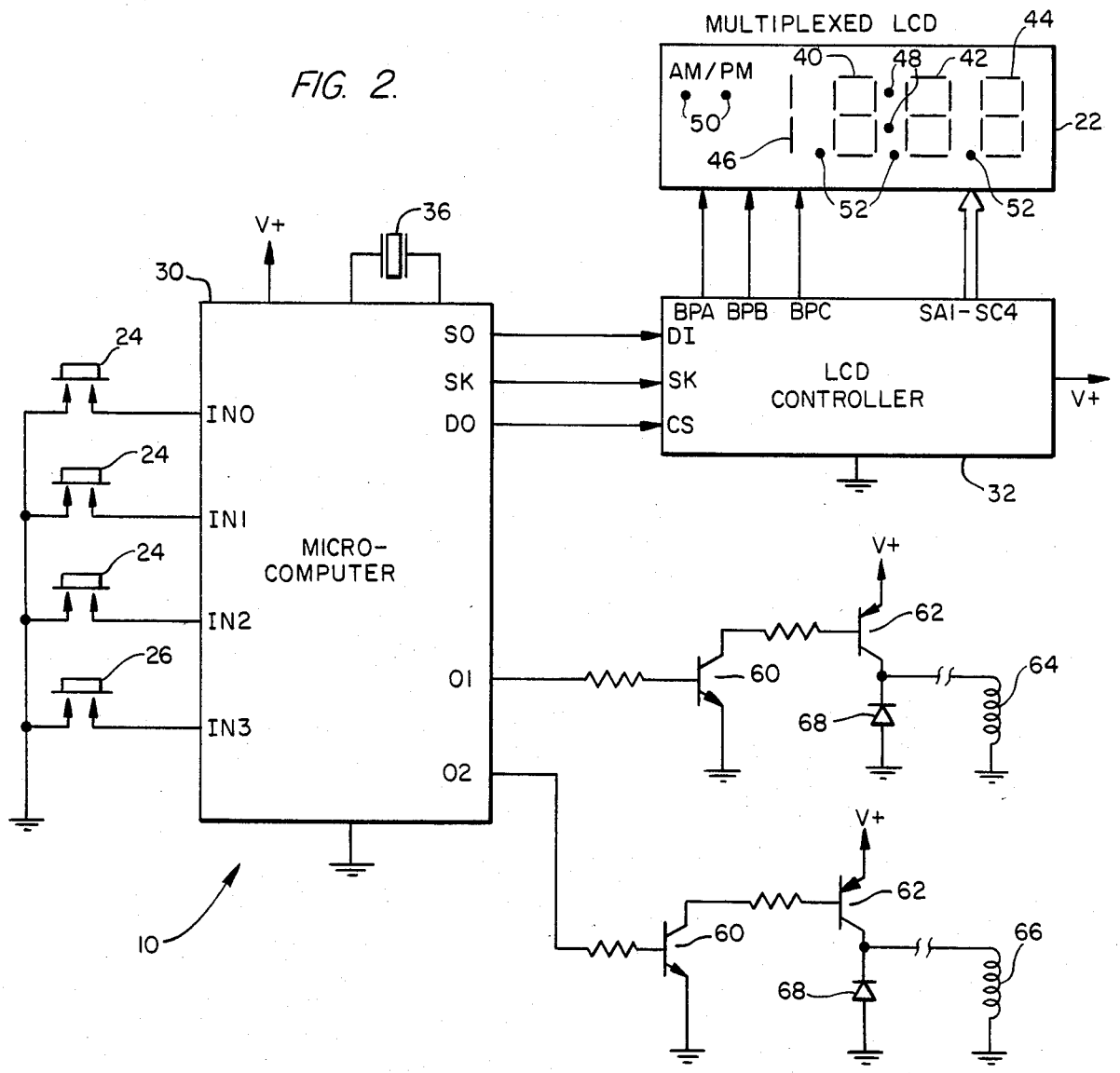
FIG. 2 is a block diagram of an electronic lock in accordance with the invention.

FIG. 2 is a block diagram of a preferred form of the electronic lock. As shown, the electronic lock may comprise a microcomputer 30; and display 22 may be a multiplexed liquid crystal display (LCD) controlled by the microcomputer via an LCD controller 32. Preferably, microcomputer 30 is a type COP421C single-chip CMOS microcontroller available from National Semiconductor Corporation, Santa Clara, Calif. This is a four-bit microcomputer that contains on a single integrated circuit chip all of the necessary system timing, internal logic, ROM, RAM, and I/O necessary to form a complete microcomputer system. The LCD controller may be a type COP472 integrated circuit, also available from National Semiconductor Corporation, capable of directly driving a multiplexed 4½-digit display. Data is loaded serially into the controller from the microcomputer and is held in internal latches. The controller contains an on-chip oscillator and generates all of the necessary waveforms for driving the display.

Microcomputer 30 includes a clock oscillator that may be crystal controlled by a 32 KHz watch crystal 36. The internal ROM is used for storing control programs that control the operation of the lock, as described hereinafter, and the RAM is used, for example, for storing a user-entered combination. The microcomputer has four inputs IN0–IN3 which may be connected to push buttons 24 and 26, as illustrated. The microcomputer further has outputs SO, SK, and DO which respectively provide serial data, serial clock, and a chip select signal to corresponding inputs DI, SK, and CS of controller 32. The controller has outputs BPA, BPB, and BPC which provide signals to corresponding backplanes of the LCD, and has 12 multiplexed outputs SA1-SC4 for driving segments of the LCD.

As illustrated in FIG. 2, the LCD has a plurality of display locations. Three such locations 40, 42, and 44 (each illustrated as displaying the digit "8") are associated with the three push buttons 24 connected to inputs IN0, IN1, and IN2, respectively. In the combination mode, each push button 24 controls the digit displayed by its associated display location, as previously described. In the time mode, display locations 40, 42, and 44 are used with another display location 46 (for the digit "1") for displaying time of day. Display locations 46 and 40 are used for displaying hours, and display locations 42 and 44 are used for displaying minutes and seconds, respectively. A pair of dots 48 between display locations 40 and 42 are used in the time mode to separate the hours and minutes portions of the display, and a pair of dots 50 in the upper left of the display may be employed for indicating A.M. or P.M. The three dots 52 adjacent to display locations 40, 42, and 44 are used in combination-changing and time-set modes, as will be described shortly.

Microcomputer 30 further has a pair of outputs 01 and 02, each connected to a driver circuit comprising, as shown, a pair of transistors 60, 62, for driving respective coils 64, 66 of an electromagnetic latch, a preferred form of which will be described shortly. Output 01 issues an output signal to coil 64 for unlocking the lock, and output 02 issues a signal to coil 66 for locking the lock. When either output goes high, its associated transistors 60, 62 conduct allowing current to flow through the associated coil. As shown, each coil may be shunted by a diode 68 for suppressing negative voltage transients.

Figure 3:
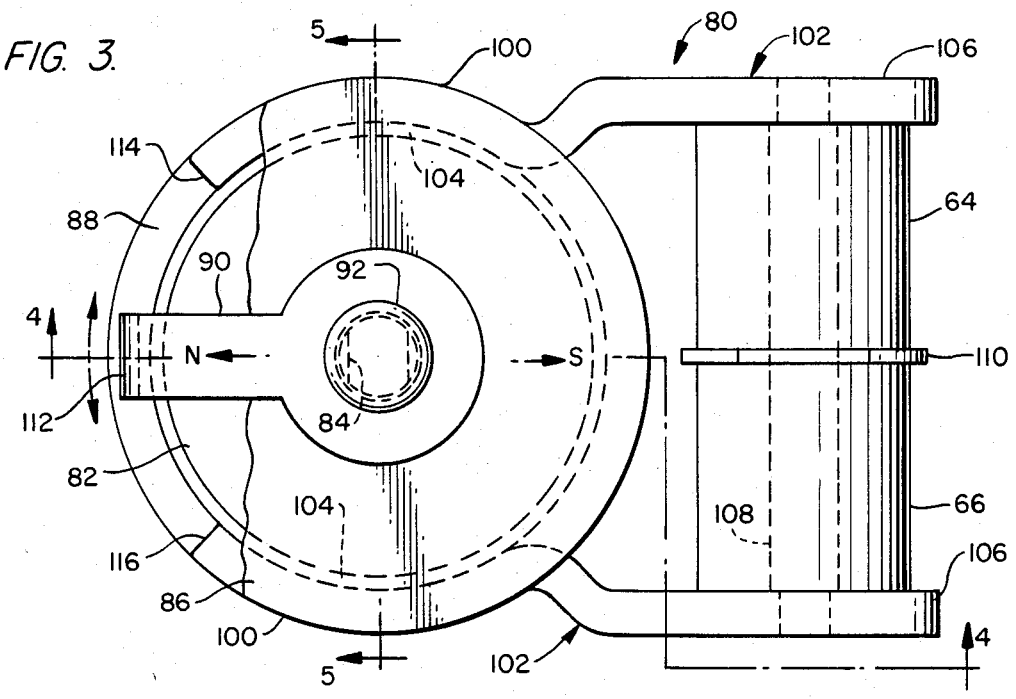
FIG. 3 is a top view, partially broken away of an electromagnetic latch that may be used with the invention.
Figure 4:
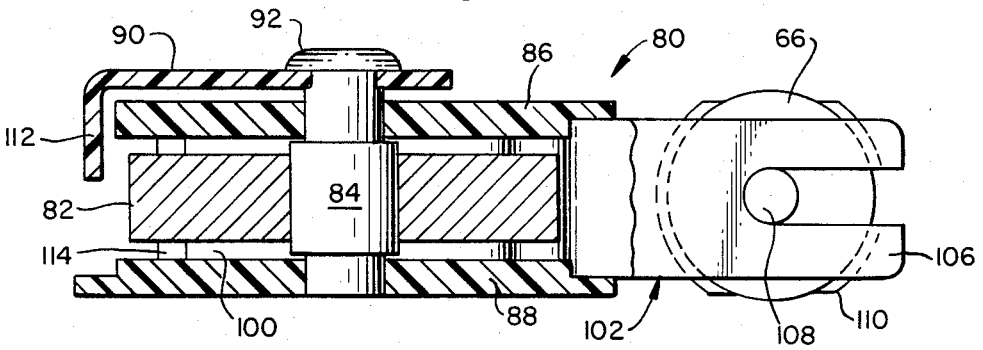
FIG. 4 is a longitudinal sectional view taken approximately along the line 4—4 of FIG. 3.
Figure 5:
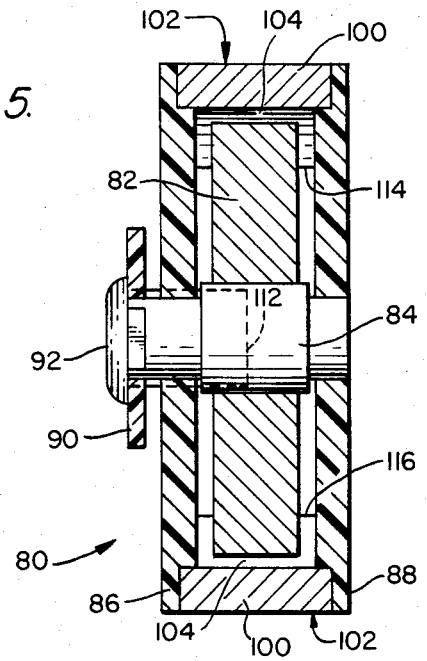
FIG. 5 is a transverse sectional view taken approximately along the line 5—5 of FIG. 3.

FIGS. 3–5 illustrate a preferred form of a bistable electromagnetic latch 80 that may be employed with the electronic lock. As shown, the electromagnetic latch may comprise a magnetic member such as a disc magnet 82 that is polarized across one diameter to provide diametrically opposed north (N) and south (S) poles on its periphery. The disc magnet is pivotally supported for rotation about its axis by a shaft 84 supported between a pair of generally planar non-magnetic support brackets 86 and 88, as best shown in FIG. 4. An angled non-magnetic stop member 90 may be connected to one end of the shaft, as by a rivet 92, so that it rotates with the disc magnet and so that it is aligned with the magnetized diameter of the disc magnet, as shown in FIG. 3.

The arcuate portions 100 of a pair of soft iron pole pieces 102 may be disposed on opposite sides of the disc magnet, as shown in FIG. 3, and held in position by the support brackets 86 and 88 so as to provide a small air gap 104 between the periphery of the disc magnet and the pole pieces. Each pole piece may have an extended portion 106 that supports one end of a soft iron coil core 108 upon which coils 64 and 66 are wound. An insulated spacer 110 may be located between the coils.

The angled portion 112 of stop member 90 cooperates with ends 114, 116 (see FIG. 3) of the pole pieces, which function as stops, to limit the rotation of the disc magnet. The magnet, the pole pieces, and the soft iron coil core form a magnetic circuit, and since the magnetic flux produced by the disc magnet prefers to take the path of least reluctance, forces will be exerted on the disc magnet to cause its north and south poles to assume positions adjacent to the pole pieces. Although in FIG. 3 stop member 90 is shown positioned midway between stops 114 and 116, this is an unstable position since any slight jar or disturbance would cause the magnet to rotate and portion 112 to snap into engagement with either stop 114 or stop 116.

The two rotational positions of the magnet at which the stop member engages the ends of the pole pieces, i.e., stops 114, 116, are stable positions at which the north pole of the magnet is adjacent to the end 114 or 116 of one of the pole pieces and the south pole of the magnet is adjacent to the arcuate portion 100 of the other pole piece near its extended portion 106. The magnet will remain in a stable position without any power being applied to coils 64 or 66, and will resist movement away from either stop because of the magnetic forces exerted on it. In fact, the magnet will snap back to a stop position if rotated less than half of its stroke, i.e., to the midway position of FIG. 3, and released. As noted hereinafter, the two stable positions correspond to locked and opened positions of the electromagnetic latch.

Coils 64 and 66 may be wound in opposite directions on the soft iron coil core 108 so that when a DC voltage is applied to coil 64 the polarity of the magnetic flux produced across the pole pieces is opposite to that produced when coil 66 is energized. Accordingly, if coil 64 is energized and the disc magnet 82 is in a rotational position such that the magnetic flux produced by coil 64 and the magnetic flux produced by the magnet are of the same polarity, the magnet will snap to its other stable position where the polarities are opposite. Subsequent voltage pulses (of the same polarity) on coil 64 will have no effect on the rotational position of the magnet. However, if a DC voltage (of the same polarity as that applied to coil 64) is next applied to coil 66, the resulting magnetic flux across the pole pieces will have an opposite polarization to that produced by coil 64, and will cause the magnet to snap back to its initial position. Accordingly, energizing one coil will cause the disc magnet to snap to one stable position, and subsequently energizing the other coil will cause it to snap to the other position. As noted above, energizing the same coil a second or more times will not cause a change in the state of the electromagnetic latch. Therefore, accidentally energizing the wrong coil will not cause the latch to latch when it should be opened or to open when it should be latched. Of course, a single coil energized by opposite polarity voltage sources may also be employed for controlling the latch.

The electromagnetic latch can be switched from one stable position to the other using only a momentary voltage pulse. Once it is switched, it is magnetically latched in position and will remain in that position without the necessity for the further application of electrical power. Thus, elecrical power is conserved, which is important when using batteries as a power source. A voltage pulse of the order of 0.5 second or less is capable of switching the electromagnetic latch from one position to the other. Assuming four 1.5 volt alkaline pen light batteries as a power source and a coil resistance of 64 ohms, the coil current would be 0.094 amps, which would generate approximately 182 ampereturns of magnetomotive force for coils having aproximately 1,950 turns. This would enable the case to be locked and unlocked approximately 10,000 times over a one-year period while still having one-half of the rated power remaining in the batteries. Because of its symmetrical design, the rotary disc magnet is balanced about its pivotal axis and is highly resistant to shock and vibration. Moreover, because of its simple design, the electromagnetic latch is low in cost.

The electromagnetic latch may be coupled to a latching mechanism to control it in many different ways. For example, a tab could be added to stop member 90 so that in one position of the latch the tab would enter an area that would block the movement of an actuator or some other movable member of the latching mechanism. Preferably, the latch is interfaced with the latching mechanism so that in its quiescent state no component of the latching mechanism engages the tab, the stop member or any other portion of the disc magnet (except when the latching mechanism is operated and the electromagnetic latch is in blocking position), since this would add additional friction which would have to be overcome for switching. Of course, the latch may also be interfaced with the latching mechanism using other arrangements employing cams, levers or rods. However, this may add friction and mechanical load to the latch, which would result in higher current drain and reduced battery life.

As indicated earlier, the operation of the electronic lock is controlled by the microcomputer 30 (FIG. 2) in accordance with the programs stored in its ROM. A preferred operation will now be described.

Preferably, display 22 normally displays time. To open the lock, first the lock/mode push button 26 is depressed to enter the combination mode. This disables the time display and the lock may be then set on-combination using push buttons 24 to enter the combination, one digit at a time. As noted earlier, each time a push button is depressed, its associated display location displays the next successive digit in the sequence. Holding the button depressed automatically may advance the display location through the sequence of digits. When the correct digit appears at the associated display locations, the push button is released. The next push button is depressed and the next digit of the combination is entered in a similar manner. When the correct combination is displayed, the lock/mode push button 26 may be depressed. This causes the displayed combination, which may be temporarily stored in reselected locations of the RAM, to be compared to the previously stored combination of the lock. If the displayed combination and the previously stored combination match, i.e., the lock is on-combination, output 01 of the microcomputer will go high for a predetermined period of time, e.g., 0.5 second, which turns on its associated transistors 60 and 62 and applies a positive voltage pulse to coil 64. This switches the electromagnetic latch 80 to open position, as previously described, and causes the display to automatically revert to the time mode so that the combination cannot be observed by unauthorized persons. To lock the case, pushing any one of push buttons 24 when the lock is on-combnation will cause output 02 of the microcomputer to go high for the predetermined period of time, thereby applying a positive voltage pulse to coil 66 which switches the electromagnetic latch to locked position.

Whenever the electronic lock is energized by inserting batteries, the combination is automatically set at 0-0-0, and time is displayed. To reset the lock to a different combination or to reset an existing combination to a new combination, the lock is first set on-combination. Then, two of the push buttons 24, e.g., the push buttons associated with inputs IN0 and IN2, are simultaneously depressed. A decimal point 52 (FIG. 2) will appear in front of each of the display locations 40, 42, and 44. Push buttons 24 are then used to enter the new combination into the display. When the desired new combination is displayed, pressing the lock/mode push button 26 causes the combination to be stored in the RAM of the microcomputer in place of the old combination and returns the electronic lock to normal operation. The decimal points will disappear and the display will return to the time mode.

To set the correct time, with the electronic lock in the time mode, two of push buttons 24, e.g., those associated with inputs IN0 and IN2, may be simultaneously depressed, causing decimal points 52 to appear on the display as before. The correct seconds, minutes and hours are then entered, in succession, using the lock/mode push button 26 as follows. First, the lock/mode push button is depressed and held until display location 44 indicates the desired seconds. When the desired seconds appear, the push button is released. Next, the push button is again depressed and held until display location 42 indicates the desired minutes, at which time it is again released. The push button is then depressed and held for a third time until display locations 40 and 46 (if required) indicate the desired hours, and the A.M./P.M. indicator is correct. A.M. and P.M. may be indicated, for example, by the dots 50 on the display. Once the correct time has been set, the electronic lock may be removed from the time-set mode by again depressing the two push buttons 24 used to enter the time-set mode. The decimal points 52 will disappear, and the display will indicate the correct time.

Preferably, the electronic lock also incorporates a fail-safe feature that automatically causes it to switch to the unlocked position when the battery voltage drops to a predetermined level, thereby avoiding a locked case with dead batteries. The lock will thereafter remain inoperative until the batteries are replaced. If desired, a low battery indicator may also be provided on the display to indicate when the batteries should be replaced.

The electronic lock may also incorporate other features, if desired, such as an alarm beeper that will signal locking and unlocking action, a calendar mode whereby the display also displays the date, and a "zero" stop feature whereby holding a push button 24 depressed (when in the combination mode) advances its associated display location through the sequence of digits until "0" is displayed. The lock could then be set on-combination simply by depressing each push button the required number of times to enter the correct set of digits. This is useful, for example, for opening the lock in the dark. The zero stop feature could also be implemented by automatically setting the display to 0-0-0 each time the combination mode is entered.

Control programs for microcomputer 30 to enable the foregoing functions to be performed may be readily implemented using existing programs and techniques well known to those skilled in the art. Appendix A presents a preferred program for implementing these functions.

While a preferred embodiment of the invention has been shown and described, it will be apparent to those skilled in the art that changes can be made in this embodiment without departing from the principles and spirit of the invention, the scope of which is defined in the appended claims.

APPENDIX A

| | | | |
|---|---|---|---|
| 000 | 00 | RESET | CLRA |
| 001 | 3364 | | LEI #$4; L DRIVERS ENABLED |
| 003 | 3388 | | LBI #$08 |
| 005 | 70 | | STII #$0 |
| 006 | 00 | | CLRA |
| 007 | 333C | | CAMQ; ZERO Q LATCHES |
| 009 | 50 | | CAB |
| 00A | 333E | | OBD |
| 00C | 3351 | | OGI #$1 |
| 00E | 3352 | | OGI #$2 |
| 010 | 3354 | | OGI #$4 |
| 012 | 3350 | | OGI #$0 |
| 014 | 44 | | NOP |
| 015 | 3D | | LBI #$3E |
| 016 | 70 | | STII #$0 |
| 017 | 0B | | LBI #$0C |
| 018 | 75 | | STII #$5 |
| 019 | 75 | | STII #$5 |
| 01A | 75 | | STII #$5; STORE INIT. COMB. |
| 01B | 08 | | LBI #$09 |
| 01C | 70 | | STII #$0 |
| 01D | 70 | | STII #$0 |
| 01E | 70 | | STII #$0; ZERO COMB DISPLAY REG. |
| 01F | 29 | | LBI #$2A |
| 020 | 7F | | STII #$3B |
| 021 | 3A | | LBI #$3B |
| 022 | 70 | | STII #$0; SET COMB DISPLAY MODE |
| 23 | 3398 | | LBI #$18 |
| 25 | 00 | BK | CLRA; CLEARS SECS/MINS/HOURS & SET AM. |
| 27 | E5 | | JP BK; SAME PAGE JUMP. |
| 28 | 3388 | | LBI #$08; SCRATCH PAD |
| 2A | 332C | | CQMA |
| 2C | 46 | | SMB #$2; SET CLOSE |
| 2D | 4C | | RMB #$0; SET COLON OFF |
| 2E | 06 | | X |
| 2F | 333C | | CAMQ |
| 31 | 33A8 | | LBI #$28 |

APPENDIX A-continued

| | | | |
|---|---|---|---|
| 33 | 7E | | STII #$F |
| 34 | 77 | | STII #$7 |
| 35 | 80 | | JSRP TMDEL |
| 36 | 3E | | LBI #$3F |
| 37 | 332C | | CQMA |
| 39 | 42 | | RMB #$2 |
| 3A | 06 | | X |
| 3B | 333C | | CAMQ; CLEAR CLOSE SOLENOID |
| 3D | 2B | | LBI #$2C |
| 3E | 70 | | STII #$0; CLOSED FLAG SET |
| 03F | 33A8 | NORMAL | LBI #$08 |
| 41 | 71 | | STII #$01 |
| 42 | 71 | | STII #$01 |
| 43 | 80 | | JSRP TMDEL |
| 44 | 3328 | NOTIME | ININ; INPVTS KEYS TO A |
| 46 | 44 | | NOP |
| 47 | 51 | | AISC #$1 |
| 48 | CC | | JP KEYPRG; KEY DEPRESSED |
| 49 | 636A | | JMP KEYDN; NO KEY PRESSED |
| 4B | 44 | | NOP |
| 4C | 3D | KEYPRG | LBI #$3E; KEY FLAG REG. |
| 4D | 00 | | CLRA |
| 4E | 21 | | SKE |
| 4F | 636A | | JMP KEYDN; TEST FOR KEY TOOPEN |
| 51 | 40 | | COMP |
| 52 | 06 | | X; SET KEY FLAG |
| 53 | 33A8 | | LBI #$28 |
| 55 | 70 | | STII #$0 |
| 56 | 72 | | STII #$5 |
| 57 | 80 | | JSRP TMDEL; 0.1 SEC DELAY |
| 58 | 3328 | | ININ; READ KEYS IN |
| 5A | 3D | | LBI#$3E |
| 5B | 63E2 | | JMP FIXAGN |
| 5D | 44 | | |
| 5E | 4444 | | |
| 60 | 29 | OPON | LBI #$2A; OPEN KEY ONLY |
| 61 | 00 | | CLRA |
| 62 | 40 | | COMP |
| 63 | 21 | | SKE |
| 64 | 62F8 | | JMP PROG; IF = TO ZERO PROG. MODE |
| 66 | 2309 | | LDD #$09 |
| 68 | 0B | | LBI #$0C |
| 69 | 21 | | SKE |
| 6A | F7 | | JP FLIP |
| 6B | 230A | | LDD #$0A |
| 6D | 0C | | LBI #$0D |
| 6E | 21 | | SKE |
| 6F | F7 | | JP FLIP |
| 70 | 230B | | LDD #$0B |
| 72 | 0D | | LBI #$0E |
| 73 | 21 | | SKE |
| 74 | F7 | | JP FLIP |
| 75 | 6227 | | JMP OPSOL; IF DISP = COMB OPEN |
| 77 | 69A9 | FLIP | JSR CLSOL |
| 79 | 3A | FLIP | LBI #$3B |
| 7A | 00 | | CLRA |
| 7B | 21 | | SKE |
| 7C | 6225 | | JMP COMX |
| 7E | 6220 | | JMP CONX |
| 220 | 71 | CONX | STII #$1; NOW COMB/SET TIME |
| 221 | 4444 | FX | NOP NOP; CLEAR SOL, 2 |
| 223 | 636A | | JMP KEYDN |
| 225 | 70 | COMX | STII #$0; NOW TIME/SET COMB |
| 226 | E1 | | JP FX |
| 227 | 2B | OPSOL | LBI #$2C |
| 228 | 00 | | CLRA |
| 229 | 21 | | SKE |
| 22A | ED | | JP BUZONL |
| 22B | 7F | | STII #$F; NEEDS OPENING |
| 22C | F4 | | JP BUZ+ |
| 22D | 3388 | BUZONL | LBI #$08 |
| 22F | 332C | | CQMA |
| 231 | 06 | | X |
| 232 | 43 | | RMB #$3 |
| 233 | Fb | | JP OFVER |

APPENDIX A-continued

| | | | |
|---|---|---|---|
| 234 | 3388 | BNZ+ | LBI #$08 |
| 236 | 332C | | CQMA |
| 238 | 06 | | X |
| 239 | 4D | | SMB #$0 |
| 23A | 47 | OFVER | SMB #$1 |
| 23B | 333C | CONTIN | CAMQ; TURN FUNCTIONS ON |
| 23D | 33A8 | | LBI #$28 |
| 23F | 7F | | STII #$F |
| 240 | 7F | | STII #$F |
| 241 | 80 | | JSRP TMDEL |
| 242 | 33A8 | | LBI #$28 |
| 244 | 7F | | STII #$F |
| 245 | 7F | | STII #$F |
| 246 | 80 | | JSRP TMDEL |
| 247 | 332C | | CQMA |
| 249 | 06 | | X |
| 24A | 45 | | RMB #$1 |
| 24B | 4C | | RMB #$0 |
| 24C | 333C | | CAMQ; TURN FUNCTIONS OFF |
| 24E | 6079 | CLD | JMP FLIPX |
| 250 | 636A | KYDX | JMP KEYDN |
| 252 | 33A8 | ON1 | LBI #$28 |
| 254 | 71 | | STII #$F |
| 255 | 71 | | STII #$7 |
| 256 | 80 | | JSRP TMDEL |
| 257 | 33A8 | | LBI #$28 |
| 259 | 7F | | STII #$F |
| 25A | 72 | | STII #$7 |
| 25B | 80 | | JSRP TMDEL; ½ TO/SEC DELAY |
| 25C | 2E | | LBI #$2F |
| 25D | 3328 | | ININ |
| 25F | 40 | | COMP |
| 260 | 06 | | X |
| 261 | 05 | | LD; STORE ININ PERM |
| 262 | 01 | | SKMBZ |
| 263 | D0 | | JP KYDX |
| 264 | 44 | | NOP |
| 265 | 2E | ONGS | LBI #$2F; ONLY 3 OTHER KEYS ON |
| 266 | 44 | | NOP |
| 267 | 44 | | NOP |
| 268 | 00 | | CLRA |
| 269 | 44 | | NOP |
| 26A | 5E | | AISC #$E |
| 26B | 21 | | SKE |
| 26C | 62A0 | | JMP NOX: NOT ALL CLOSED |
| 26E | 3A | | LBI #$3B |
| 26F | 00 | | CLRA |
| 270 | 21 | | SKE; IF = 0 THEN COMB |
| 271 | 6293 | | JMP TMB; TIME MODE |
| 273 | 39 | | LBI #$3A |
| 274 | 70 | | STII #$0; PROG. DEF. COMB |
| 275 | 2309 | | LDD #$09 |
| 277 | 0B | | LBI #$0C |
| 278 | 21 | | SKE |
| 279 | 628F | UPXX | JMP OKSKB |
| 27B | 230A | | LDD #$0A |
| 27D | 0C | | LBI #$0D |
| 27E | 21 | | SKE |
| 27F | F9 | | JP UPXX |
| 280 | 44 | | NOP |
| 281 | 230B | | LDD #$0B |
| 283 | 0D | | LBI #$0E |
| 284 | 21 | | SKE |
| 285 | CF | | JP OKSBK |
| 286 | 44 | | NOP |
| 287 | 6995 | | JSR PPZRO; SET PROG. PASS |
| 289 | 39 | | LBI #$3A |
| 28A | 70 | | STII #$0; SET COMB MODE PROG. |
| 28B | 29 | | LBI #$2A |
| 28C | 70 | | STII #$0; SET PROG. MODE |
| 28D | 636A | | JMP KEYDN |
| 28F | 69C8 | OKSBK | JSR PPFL |
| 291 | 636A | | JMP KEYDN |
| 293 | 39 | TMB | LBI #$3A |
| 294 | 7F | | STII #$F; TIME PROG. |
| 295 | 0E | | LBI #$0F |
| 296 | 70 | | STII #$0; SECONDS POINTER/PROG. |

APPENDIX A-continued

| | | | |
|---|---|---|---|
| 297 | 29 | | LBI #$2A; CHECK PROG MODE |
| 298 | 00 | | CLRA |
| 299 | 21 | | SKE |
| 29A | DE | | JP ST; NON-PROG MODE |
| 29B | 7F | | STII #$F; PROG MODE |
| 29C | 63F6 | ND | JMP ALLCLR |
| 29E | 63B5 | ST | JMPKZ |
| 2A0 | 00 | NOX | CLRA; NOT ALL CLOSED |
| 2A1 | 44 | | NOP |
| 2A2 | 52 | | AISC #$2 |
| 2A3 | 21 | | SKE |
| 2A4 | E7 | | JP PRNT |
| 2A5 | EF | | JP LKFTHR |
| 2A6 | 44 | | NOP |
| 2A7 | 52 | PRNT | AISC #$2 |
| 2A8 | 21 | | SKE |
| 2A9 | EB | | JP PRNNT |
| 2AA | EF | | JP LKFTHR |
| 2AB | 54 | PRNNT | AISC #$4 |
| 2AC | 21 | | SKE |
| 2AD | 636A | | JMP KEYDN; 1 KEY |
| 2AF | 3A | LKFTHR | LBI #$3B |
| 2B0 | 00 | | CLRA |
| 2B1 | 21 | | SKE |
| 2B2 | 62 | | JMP TMCHG; TIME MODE |
| 2B4 | 29 | | LBI #$2A; PROG. MODE |
| 2B5 | 00 | | CLRA |
| 2B6 | 40 | | COMP |
| 2B7 | 21 | | SKE |
| 2B8 | 6995 | | JSR PPZRO; SET PROG. PASS. REG. |
| 2BA | 2C | | LBI #$2D |
| 2BB | 00 | | CLRA |
| 2BC | 52 | | AISC #$2 |
| 2BD | 06 | | X |
| 2BE | 05 | | LD |
| 2BF | 2E | | LBI #$2F |
| 2C0 | 21 | | SKE; IS D1 DEPRESSED |
| 2C1 | C8 | | JP D2 |
| 2C2 | 2D | | LBI #$2E |
| 2C3 | 79 | | STII #$9; SET D1 ADDR |
| 2C4 | 63F0 | | JMP PRDGIC; INCR. DIGIT #1 |
| 2C6 | 4444 | | NOP NOP |
| 2C8 | 2C | D2 | LBI #$2D |
| 2C9 | 52 | | AISC #$2 |
| 2CA | 06 | | X |
| 2CB | 05 | | LD |
| 2CC | 2E | | LBI #$2F |
| 2CD | 21 | | SKE; IS D2 DEPRESSED |
| 2CE | D5 | | JP D3 |
| 2CF | 2D | | LBI #$2E |
| 2D0 | 7A | | STII #$A; SET D2 ADDR |
| 2D1 | 63F0 | | JMP PRDGIC; INE DIGIT #2 |
| 2D3 | 4444 | | NOP NOP |
| 2D5 | 2C | D3 | LBI #$2D |
| 2D6 | 54 | | AISC #$4 |
| 2D7 | 06 | | X |
| 2D8 | 05 | | LD |
| 2D9 | 2E | | LBI #$2F |
| 2DA | 21 | | SKE; IS D3 DEPRESSED |
| 2DB | 636A | | JMP KEYDN |
| 2DD | 2D | | LBI #$2E |
| 2DE | 7B | | STII #$B; SET D3 ADDR |
| 2DF | 63F0 | | JMP PRDGIC; INC DIGIT 3 |
| 2E1 | 4444 | | NOP NOP |
| 2E3 | 2E | TMCHG | LBI #$2F |
| 2E4 | 00 | | CLRA |
| 2E5 | 52 | | AISC #$2 |
| 2E6 | 21 | | SKE |
| 2E7 | 636A | | JMP KEYDN |
| 2E9 | 3A | | LBI #$3B |
| 2EA | 6398 | | JMP FIXIT; DISPLAY SECS. |
| 2EC | 7E | FXTT | STII #$F |
| 2ED | 7F | | STII #$7 |
| 2EE | 80 | | JSRPTMDEL |
| 2EF | 33A8 | | LBI #$28 |
| 2F1 | 7F | | STII #$F |
| 2F2 | 7F | | STII #$7 |
| 2F3 | 80 | | JSRP TMDEL; .75 SEC. |
| 2F4 | 3A | | LBI #$3B |
| 2F5 | 71 | | STII #$1; CHANGE BACK TO |

APPENDIX A-continued

| | | | |
|---|---|---|---|
| | | | MIN/SECS HRS. |
| 2F6 | 636A | | JMP KEYDN |
| 2F8 | 3A | PROG | LBI #$3B |
| 2F9 | 00 | | CLRA |
| 2FA | 21 | | SKE |
| 2FB | 630D | | JMP TMPROG |
| 2FD | 0B | | LBI #$0C |
| 2FE | 2309 | | LDD #$09 |
| 300 | 04 | | XIS |
| 301 | 230A | | LDD #$0A |
| 303 | 04 | | XIS |
| 304 | 230B | | LDD #$0B |
| 306 | 04 | | XIS; COMB OVERWRITTEN |
| 307 | 29 | | LBI #$2A |
| 308 | 7F | | STII #$F; STORE PROG MODE |
| 309 | 3A | | LBI #$3B |
| 30A | 71 | | STII #$1; SET TIME HRS/MIN |
| 30B | 63A0 | | JMP ALFIX |
| 30D | 0E | TMPROG | LBI #$0F |
| 30E | 00 | | CLRA |
| 30F | 21 | | SKE |
| 310 | D3 | | JP MINSCK |
| 311 | E2 | | JP SECSET |
| 312 | 44 | | NOP |
| 313 | 44 | MINSCK | NOP |
| 314 | 51 | | AISC #$1 |
| 315 | 21 | | SKE |
| 316 | D9 | | JP HRSCK |
| 317 | 6345 | | JMP MNSET |
| 319 | 44 | HRSCK | NOP |
| 31A | 51 | | AISC #$1 |
| 31B | 21 | | SKE |
| 31C | DF | | JP HRNOT |
| 31D | 634D | | JMP HRSET |
| 31F | 70 | HRNOT | STII #$0; SET TIME PROG = SEC'S. |
| 320 | 636A | | JMP KEYDN |
| 322 | 3A | SECSET | LBI #$3B |
| 323 | 72 | | STII #$2; SET SECS DISPLAY |
| 324 | 1E | | LBI #$1F |
| 325 | 70 | | STII #$0; SET LSD BLINK |
| 326 | 2C | | LBI #$2D |
| 327 | 44 | | NOP |
| 328 | 79 | | STII #$9 |
| 329 | 68E8 | PSXAGN | JSR DISP |
| 32B | 6962 | | JSR BLINK |
| 32D | 69F3 | | JSR PKEYHL |
| 32F | 21 | | SKE |
| 330 | F8 | | JP INXAGN |
| 331 | 0E | | LBI #$0F |
| 332 | 22 | | SC |
| 333 | 00 | | CLRA |
| 334 | 30 | | ASC |
| 335 | 06 | | X |
| 336 | 636A | | JMP KEYDN |
| 338 | 33A8 | INXAGN | LBI #$28; TIME DELAY |
| 33A | 7F | | STII #$F |
| 33B | 71 | | STII #$7 |
| 33C | 80 | | JSRP TMDEL |
| 33D | 1F | | LBI #$10 |
| 33E | 232D | | LDD #$2D |
| 340 | 50 | | CAB |
| 341 | 63B0 | | JMP KXX |
| 343 | 44 | | NOP |
| 344 | 44 | | NOP |
| 345 | 3A | MNSET | LBI #$3B |
| 346 | 71 | | STII #$1; SET MIN/SET DISPLAY |
| 347 | 1E | | LBI #$1F |
| 348 | 70 | | STII #$0; SET LSB BLINK |
| 349 | 7B | | STII #$B |
| 34B | C1 | | JP PSXAGN |
| 34C | 44 | | NOP |
| 34D | 3A | HRSET | LBI #$3B |
| 34E | 71 | | STII #$1; SET HRS MIN |
| 34F | 1E | | LBI #$1F |
| 350 | 7F | | STII #$F; SET MSD BLINK |
| 351 | 2C | | LBI #$2D |
| 352 | 44 | | NOP |
| 353 | 7D | | STII #$D |
| 354 | 68E8 | PZXAGN | JSR DISP |
| 356 | 6962 | | JSR BLINK |

APPENDIX A-continued

| | | | |
|---|---|---|---|
| 358 | 69F3 | | JSR PKEYHL |
| 35A | 21 | | SKE |
| 35B | E1 | | JP IEXAGN |
| 35C | 44 | | NOP |
| 35D | 0E | | LBI #$0F |
| 35E | 70 | | STII #$0 |
| 35F | 636A | | JMP KEYDN |
| 361 | 33A8 | IEXAGN | LBI #$28 |
| 363 | 70 | | STII #$0 |
| 364 | 77 | | STII #$7 |
| 365 | 80 | | JSRP TMDEL |
| 366 | 69FC | | JSR HZINC |
| 368 | D4 | | JP PZXAGN |
| 369 | 44 | | NOP |
| 36A | 3328 | KEYDN | ININ |
| 36C | 40 | | COMP |
| 36D | 2E | | LBI #$2F |
| 36E | 70 | | STII #$0 |
| 36F | 2E | | LBI #$2F |
| 370 | 21 | | SKE |
| 371 | F5 | | JP OVERCL; KEYS STILL DEPRESSED |
| 372 | 06 | | X |
| 373 | 3D | | LBI #$3E |
| 374 | 06 | | X; CLEAR KEY FLAG REG |
| 375 | 68E8 | OVERCL | JSR DISP |
| 377 | 0F | | LBI #$0 |
| 378 | 22 | | SC |
| 379 | 00 | | CLRA |
| 37A | 30 | | ASC |
| 37B | 16 | | X,01 |
| 37C | 20 | | SKC |
| 37D | 603F | UP | JMP NORMAL |
| 37F | 00 | | CLRA |
| 380 | 30 | | ASC |
| 381 | 36 | | X,11 |
| 382 | 20 | | SKC |
| 383 | 637D | HUP | JMP UP |
| 385 | 00 | | CLRA |
| 386 | 30 | | ASC |
| 387 | 16 | | X,01 |
| 388 | 20 | | SKC |
| 389 | C3 | | JP HUP |
| 38A | 00 | | CLRA |
| 38B | 30 | | ASC |
| 38C | 06 | | X |
| 38D | 20 | | SKC |
| 38E | C3 | | JP HUP |
| 38F | 603F | | JMP NORMAL |
| 391 | 7F | | STII #$F |
| 392 | 74 | | STII #$04 |
| 393 | 80 | | JSRP TMDEL |
| 394 | 39 | | LBI #$2A |
| 395 | 7F | | STII #$F |
| 396 | 63F6 | | JMP ALCLR |
| 398 | 06 | FIXIT | X; SECS MODE |
| 399 | 68E8 | | JSR DISP |
| 39B | 33A8 | | LBI #$28 |
| 39D | 62EC | | JMP FXTT |
| 3E2 | 21 | FIXAGN | SKE |
| 3E3 | E6 | | JP OFVR |
| 3E4 | 636A | | JMP KEYDN; NONE DEPRESSED |
| 3E6 | 40 | OFVR | COMP |
| 3E7 | 5E | | AISC #$E |
| 3E8 | 6060 | | JMP OPON |
| 3EA | 6252 | | JMP ON1 |
| 3F0 | 69A9 | PRDGIC | JSR CLSOL |
| 3F2 | 69D8 | | JSR DIGINC |
| 3F4 | 636A | | JMP KEYDON |
| 3F6 | 3388 | ALCLR | LBI #$08 |
| 3F8 | 332C | | CQMA |
| 3FA | 43 | | RMB #$3 |
| 3FC | 333C | | CAMQ |
| 3FE | 603F | | JMP NORMAL |
| 3B0 | 68CF | KXX | JSR ADD60 |
| 3B2 | 44 | | NOP |
| 3B3 | 6329 | | JMP PSXAGN |
| 3B5 | 06 | K2 | X |
| 3B7 | 3388 | | LBI #$08 |
| 338 | 332C | | CQMA |
| 3BA | 06 | | X |

APPENDIX A-continued

| | | | |
|---|---|---|---|
| 3BB | 4B | | SMB #$3 |
| 3BC | 333C | | CAMQ |
| 3BF | 636A | END | JMP KEYDN |
| 3A0 | 3388 | ALLFIX | LBI #$08 |
| 3A2 | 332C | | CQMA |
| 3A4 | 06 | | X |
| 3A5 | 43 | | RMB #$3 |
| 3A6 | 333C | | CAMQ |
| 3A8 | 6227 | | JMP OPSOL |
| ;PRECEDE BY LOADING 28/29 WITH # OF PASSES | | | |
| 0080 | 33/B8 | TMDEL | LBI #$38 |
| 0082 | 7F | | STII #$F |
| 0083 | 7F | | STII #$F; STORE INTERM TIMERS |
| 0084 | 00 | SUBC | CLRA; IN 38/39 |
| 0085 | 32 | SUBA | RC; SET BORROW |
| 0086 | 10 | | CASC |
| 0087 | 8A | | JP NSB; BORROW |
| 0088 | 06 | | X; NO BORROW |
| 0089 | 85 | | JP SUBA |
| 008A | 06 | NSP | X |
| 008B | 33B8 | | LBI #$38 |
| 008D | 00 | | CLRA |
| 0085 | 10 | | CASC |
| 008F | 93 | | JP TIMUP; BORROW |
| 0090 | 06 | | X; NO BORROW |
| 0091 | 38 | | LBI #$39 |
| 0092 | 84 | | JP SUBC |
| 0093 | 44 | TIMUP | NOP; INITIAL 2 MSEC |
| 0094 | 41 | | SKT |
| 0095 | 98 | | JP NOPE |
| 0096 | 60AD | | JMP TMSUB |
| 0098 | 33A8 | NOPE | LBI #$28 |
| 009A | 00 | | CLRA |
| 009B | 32 | | RC |
| 009C | 10 | | CASC |
| 009D | A0 | | JP NSC; BORROW |
| 009E | 06 | | X; NO BORROW |
| 009F | 80 | | JP TMDEL |
| 00A0 | 06 | NSC | X |
| 00A1 | 28 | | LBI #$29 |
| 00A2 | 00 | | CLRA |
| 00A3 | 10 | | CASC |
| 00A4 | A9 | | JP TMUP |
| 00A5 | 06 | | X |
| 00A6 | 44 | | NOP |
| 00A7 | 44 | | NOP |
| 00A8 | 80 | | JP TMDEL; SEC PASSES OVER |
| 00A9 | 48 | TMUP | RET; FINISH |
| 00AA | 44 | | NOP |
| 00AB | 44 | | NOP |
| 00AC | 44 | | NOP |
| 00AD | 29 | TMSUP | LBI #$2A |
| 00AE | 00 | | CLRA |
| 00AF | 21 | | SKE |
| 00B0 | B5 | | JP TMMUB; ≠ PROG MODE |
| 00B1 | 3A | | LBI #$3B; = PROG MODE |
| 00B2 | 00 | | CLRA |
| 00B4 | 98 | | JP NOPE |
| 00B5 | 3B | TMMUB | LBI #$3C |
| 00B6 | 32 | | RC; SUBTRACT ONE (BORROW) |
| 00B7 | 00 | | CLRA |
| 00B8 | 10 | | CASC |
| 00B9 | 44 | | NOP |
| 00BA | 04 | | XIS |
| 00BB | 00 | | CLRA |
| 00BC | 10 | | CASC |
| 00BD | C0 | | JP GN |
| 00BE | 06 | | X |
| 00BF | 98 | | JP NOPE |
| 00C0 | 77 | GN | STII #$7 |
| 00C1 | 3B | | LBI #$3C; 128 RESET (127) |
| 00C2 | 7F | | STII #$F |
| 00C3 | 18 | | LBI #$19; SECS On |
| 00C4 | 68CF | | JSR ADD60 |
| 00C6 | 98 | | JP NOPE |
| 00C7 | 1A | | LBI #$1B; MINUTES |
| 00C8 | 68CF | | JSR ADD60 |
| 00CA | 98 | | JP NOPE |
| 00CB | 69FC | | JSR HZINC |
| 00CD | 98 | | JP NOPE |

APPENDIX A-continued

| | | | |
|---|---|---|---|
| 00CE | 44 | | NOP |
| 00CF | 22 | ADD60 | SC |
| 00D0 | 00 | | CLRA |
| 0D1 | 44 | | NOP |
| 0D2 | 56 | | AISC #$6 |
| 0D3 | 30 | | ASC |
| 0D4 | 4A | | ADT; ADD DECIMAL |
| 0D5 | 04 | | XIS |
| 0D6 | 00 | | CLRA |
| 0D7 | 56 | | AISC #$6 |
| 0D8 | 30 | | ASC |
| 0D9 | 4A | | ADT |
| 0DA | 06 | | X |
| 0DB | 00 | | CLRA |
| 0DC | 56 | | AISC #$6 |
| 0DD | 21 | | SKE |
| 0DE | 48 | | RET |
| 0DF | 00 | | CLRA; =60; ZERO SECS OR MINS |
| 0E0 | 07 | | XDS |
| 0E1 | 44 | | NOP |
| 0E2 | 49 | | RETSK |
| 0E3 | 44 | | NOP |
| 0E4 | 56 | FADTN | AISC #$6 |
| 0E5 | 30 | | ASC |
| 0E6 | 4A | | ADT |
| 0E7 | 48 | | RET |
| 0E8 | 00 | DISP | CLRA |
| 0E9 | 3A | | LBI #$3B |
| 0EA | 21 | | SKE |
| 0EB | EE | | JP NXT |
| 0EC | 6141 | | JMP COMB |
| 0EE | 44 | NXT | NOP |
| 0EF | 51 | | AISC #$1 |
| 0F0 | 21 | | SKE |
| 0F1 | F4 | | JP SECX |
| 0F2 | 6110 | | JMP MHRS |
| 0F4 | 18 | SECX | LBI #$19 |
| 0F5 | 69 SC | | JSR SBCHL |
| 0F7 | 3351 | | OGI #$1 |
| 0F9 | 3350 | | OGI #$0 |
| 0FB | 19 | | LBI #$1A |
| 0FC | 6959 | | JSR SBCHG |
| 0FE | 3352 | | OGI #$2 |
| 100 | 3350 | | OGI #$0 |
| 102 | 00 | | CLRA |
| 103 | 40 | | COMP |
| 104 | 50 | | CAB |
| 105 | 333E | | OBD |
| 107 | 3354 | | OGI #$4 |
| 109 | 3350 | | OGI #$0 |
| 10B | 00 | | CLRA |
| 10C | 50 | | CAB |
| 10D | 333E | | OBD |
| 10F | E8 | | JP LSTDEC |
| 110 | 1A | MHRS | LBI #$1B |
| 111 | 695C | | JSR SBCHL |
| 113 | 3351 | | OGI #$1 |
| 115 | 3350 | | OGI #$0 |
| 117 | 1B | | LBI #$1C |
| 118 | 6959 | | JSR SBCHG |
| 11A | 3352 | | OGI #$2 |
| 11C | 3350 | | OGI #$0 |
| 11E | 1C | | LBI #$1D |
| 11F | 6959 | | JSR SBCHG |
| 121 | 335A | | OGI #$4 |
| 123 | 3350 | | OGI #$0 |
| 125 | 1D | | LBI #$1E |
| 126 | 6959 | | JSR SBCHG |
| 128 | 3358 | LSDEC | OGI #$8 |
| 12A | 3350 | | OGI #$0; M/HRS OUT |
| 12C | 00 | LSTDEC | CLRA |
| 12D | 3398 | | LBI #$18 |
| 12F | 21 | | SKE; IF = 0 THEN AM |
| 130 | F7 | | JP PM |
| 131 | 3388 | | LBI #$08; AM SET |
| 133 | 332C | | CQMA |
| 135 | 43 | | RMB #$3; CLEAR PM/AM |
| 136 | FC | | JP CLN |
| 137 | 3388 | PM | LBI #$08 |
| 139 | 332C | | CQMA |
| 13B | 4B | | SMB #$3 |

APPENDIX A-continued

| | | | |
|---|---|---|---|
| 13C | 4D | CLN | SMB #$0 |
| 13D | 06 | | X |
| 13E | 333C | | CAMQ |
| 140 | 48 | | RET |
| 141 | 08 | COMB | LBI #$09 |
| 142 | 695C | | JSR SBCHL |
| 144 | 3351 | | OGI #$1 |
| 146 | 3350 | | OGI #$0 |
| 148 | 09 | | LBI #$0A |
| 149 | 6959 | | JSR SBCHG |
| 14B | 3352 | | OGI #$2 |
| 14D | 3350 | | OGI #$0 |
| 14F | 0A | | LBI #$0B |
| 150 | 6959 | | JSR SBCHG |
| 152 | 3354 | | OGI #$4 |
| 154 | 3350 | | OGI #$0 |
| 156 | 6BD0 | | JSR FINISH |
| 158 | 48 | | RET |
| 159 | 44 | SBCHG | NOP |
| 15A | 44 | | NOP |
| 15B | 44 | | NOP |
| 15C | 05 | SBCHL | LD |
| 15D | 50 | | CAB |
| 15E | 333E | | OBD |
| 160 | 48 | | RET |
| 161 | 44 | | NOP |
| 162 | 2A | BLINK | LBI #$2B |
| 163 | 7E | | STII #$E |
| 164 | 1E | BLINKX | LBI #$1F; BLINK SIDE |
| 165 | 00 | | CLRA |
| 166 | 21 | | SKE; IF = THEN LSDS |
| 167 | F1 | | JP MSDS |
| 168 | 3388 | | LBI #$08 |
| 16A | 332C | | CQMA; LSD'S |
| 16C | 06 | | X |
| 16D | 46 | | SMB #$2 |
| 16E | 33/3C | | CAMQ; SET BLANK |
| 170 | F9 | | JP OVER |
| 171 | 3388 | MSDS | LBI #$08 |
| 173 | 332C | | CQMA; MSD'S |
| 175 | 47 | | SMB #$1 |
| 176 | 06 | | X |
| 177 | 33/3C | | CAMQ; SET BLANK |
| 179 | 33/A8 | OVER | LBI #$28 |
| 17B | 71 | | STII #$0 |
| 17C | 71 | | STII #$C |
| 17D | 80 | | JSRP TMDEL; .2 SEC. |
| 17E | 3388 | | LBI #$08 |
| 180 | 332C | | CQMA |
| 182 | 45 | | RMB #$1 |
| 183 | 06 | | X |
| 184 | 42 | | RMB #$2 |
| 185 | 33/3C | | CAMQ; RESET ALL BLANKS |
| 187 | 33/A8 | | LBI #$28 |
| 189 | 71 | | STII #$1 |
| 18A | 73 | | STII #$3 |
| 18B | 80 | | JSRP TMDEL; .4 SEC. |
| 18C | 22 | | SC |
| 18D | 00 | | CLRA |
| 18E | 2A | | LBI #$2B |
| 18F | 30 | | ASC |
| 190 | 06 | | X |
| 191 | 20 | | SKC |
| 192 | 6164 | | JMP BLINKX; 2 PASSES |
| 194 | 48 | | RET |
| | | ;PROG PASS ZERO | |
| 195 | 0F | PPZRO | LBI #$0 |
| 196 | 00 | | CLRA |
| 197 | 44 | | NOP |
| 198 | 16 | | X (r = 01) |
| 199 | 00 | | CLRA |
| 19A | 44 | | NOP |
| 19B | 36 | | X (r = 11) |
| 19C | 00 | | CLRA |
| 19D | 44 | | NOP |
| 19E | 16 | | X (r = 01) |
| 19F | 00 | | CLRA |
| 1A0 | 06 | | X; ZERO PROG PASS |
| 1A1 | 332C | | CQMA |
| 1A3 | 06 | | X |
| 1A4 | 4B | | SMB #$3; SET PROG MODE |
| 1A5 | 333C | | CAMQ |

APPENDIX A-continued

| | | | |
|---|---|---|---|
| 1A7 | 48 | | RET |
| 1A8 | 44 | | NOP |
| 1A9 | 2B | CLSOL | LBI #$2C |
| 1AA | 00 | | CLRA |
| 1AB | 40 | | COMP |
| 1AC | 21 | | SKE |
| 1AD | 48 | | RET; NO NEED TO CLOSE |
| 1AE | 70 | | STII #$0 |
| 1AF | 3388 | | LBI #$08; NEED S TO BE CLOSED |
| 1B1 | 332C | | CQMA |
| 1B3 | 46 | | SMB #$2; CLOSE |
| 1B4 | 06 | | X |
| 1B5 | 47 | | SMB #$1; ALARM |
| 1B6 | 333C | | CAMQ |
| 1B8 | 33A8 | | LBI #$28 |
| 1BA | 7F | | STII #$F |
| 1BB | 7F | | STII #$F |
| 1BC | 80 | | JSRP TMDEL |
| 1BD | 3388 | | LBI #$08 |
| 1BF | 332C | | CQMA |
| 1C1 | 42 | | RMB #$2; DEACTIVATE SOL. |
| 1C2 | 06 | | X |
| 1C3 | 45 | | RMB #$1; ALARM |
| 1C4 | 333C | | CAMQ |
| 1C6 | 48 | | RET |
| 1C7 | 44 | | NOP |
| 1C8 | 0F | PPFL | LBI #$00 |
| 1C9 | 00 | | CLRA |
| 1CA | 40 | | COMP |
| 1CB | 16 | | X (r = 01) |
| 1CC | 00 | | CLRA |
| 1CD | 40 | | COMP |
| ICE | 36 | | X (r = 11) |
| ICF | 00 | | CLRA |
| 1D0 | 40 | | COMP |
| 1D1 | 16 | | X (r = 01) |
| 1D2 | 00 | | CLRA |
| 1D3 | 40 | | COMP |
| 1D4 | 06 | | X |
| 1D5 | 48 | | RET |
| 1D6 | 44 | | NOP |
| 1D7 | 44 | | NOP |
| 1D8 | 4444 | DIGINC | NOP NOP |
| 1DA | 2D | INCAGN | LBI #$2E |
| 1DB | 25 | | LD; LOAD DIGIT ADDR. |
| 1DC | 50 | | CAB |
| 1DD | 00 | | CLRA |
| 1DE | 22 | | SC |
| 1DF | 68E4 | | JSR FADTN |
| 1E1 | 06 | | X |
| 1E2 | 44 | | NOP |
| 1E3 | E5 | | JP STDEP |
| 1E4 | 48 | | RET |
| 1E5 | 68E8 | STDEP | JSR DISP |
| 1E7 | 33A8 | | LBI #$28 |
| 1E9 | 7F | | STII #$F |
| 1EA | 77 | | STII #$7 |
| 1EB | 80 | | JSRP TMDEL |
| 1EC | 3328 | | ININ |
| 1EE | 40 | | COMP |
| 1EF | 2C | | LBI #$2D |
| 1F0 | 21 | | SKE |
| 1F1 | 48 | | RET; NOT DEPRESSED |
| 1F2 | DA | | JP INCAGN |
| 1F3 | 3328 | PKETHL | ININ |
| 1F5 | 40 | | COMP |
| 1F6 | 3E | | LBI #$3F |
| 1F7 | 06 | | X |
| 1F8 | 05 | | LD |
| 1F9 | 4C | | RMB #$0; SET MEM BIT = 1 |
| 1FA | 48 | | RET |
| 1FB | 44 | | NOP |
| 1FC | 1C | HZINC | LBI #$1D; HRS |
| 1FD | 22 | | SC |
| 1FE | 00 | | CLRA |
| 1FF | 56 | | AISC #$6 |
| 200 | 30 | | ASC |
| 201 | 4A | | ADT |
| 202 | 04 | | XIS |
| 203 | 00 | | CLRA |
| 204 | 56 | | AISC #$6 |

APPENDIX A-continued

| | | | |
|---|---|---|---|
| 205 | 30 | | ASC |
| 206 | 4A | | ADT |
| 207 | 06 | | X; HOURS STORED |
| 208 | 1D | | LBI #$IE |
| 209 | 00 | | CLRA; NO NEED TO RC |
| 20A | 51 | | AISC #$1 |
| 20B | 21 | | SKE |
| 20C | 48 | | RET |
| 20D | 1C | | LBI #$1D |
| 20E | 51 | | AISC #$1 |
| 20F | 21 | | SKE |
| 210 | D7 | | JP THRCK; ≠ TO 12 |
| 211 | 3398 | | LBI #$18 |
| 213 | 06 | | X |
| 214 | 40 | | COMP |
| 215 | 06 | | X; TOGGLE AM/PM REG |
| 216 | 48 | | RET |
| 217 | 32 | THRCK | RC |
| 218 | 51 | | AISC #$1 |
| 219 | 44 | | NOP |
| 21A | 21 | | SKE |
| 21B | 48 | | RET |
| 21C | 71 | | STII #$1; = 13 SET HRS = 1 |
| 21D | 70 | | STII #$0 |
| 21E | 48 | | RET |
| 3D0 | 00 | FINISH | CLRA |
| 3D1 | 50 | | CAB |
| 3D2 | 333E | | OBD |
| 3D4 | 3358 | | OGI #$8 |
| 3D6 | 3350 | | OGI #$0; ZERO MSD |
| 3D8 | 3388 | | LBI #$08 |
| 3DA | 332C | | CQMA |
| 3DC | 43 | | RMB #$ 3; CLEAR AM/PM |
| 3DD | 4C | | RMB #$0; CLEAR COLON |
| 3DE | 06 | | X |
| 3DF | 333C | | CAMQ |
| 3E1 | 48 | | RET |

We claim:

1. An electronic lock comprising display means having a plurality of display locations, a plurality of push buttons, each push button being associated with a different display location, means responsive to the actuation of each push button for displaying at the associated display location a sequence of indicia and for selecting from the sequence, under the control of the push button, a selected indicium for display at the associated display location, thereby enabling a selected set of indicia to be displayed by the display means, means for storing a predetermined set of indicia corresponding to the on-combination condition of the lock, means for comparing the displayed set of indicia with the stored predetermined set of indicia, and means responsive to the comparison for operating associated latch means to open the lock when the sets of indicia match.

2. The lock of claim 1, wherein the means responsive to the actuation of a push button comprises means for displaying a next indicium of the sequence for each depression of the push button and means for successively displaying the indicia of the sequence when the push button is held depressed.

3. The lock of claim 1 further comprising means responsive to the simultaneous depression of two push buttons, upon the lock being on-combination, for storing a new predetermined set of indicia entered via said push buttons.

4. The lock of claim 1 further comprising means for automatically scrambling the indicia displayed by the display means after the lock is opened.

5. The lock of claim 4, wherein the lock has a combination display mode in which the combination indicia are displayed, and has a time display mode in which time of day is displayed in place of said indicia.

6. The lock of claim 5, wherein said automatic scrambling means comprises means for automatically placing the lock in the time display mode after it is opened.

7. The lock of claim 5 further comprising another push button, and means responsive to the actuation of said other push button for selecting the display mode.

8. The lock of claim 1, wherein said associated latch means comprises an electromagnetic latch having a movable member, the movable member having a first position at which it blocks the operation of a latch mechanism and having a second position at which it permits such operation, and wherein said operating means comprises means for applying electrical current to the electromagmetic latch to cause the movable member to move from one position to the other.

9. The lock of claim 1, wherein the lock is battery operated and further comprises means responsive to the battery voltage dropping to a predetermined level for opening the lock.

10. The lock of claim 1, wherein said displaying and selecting means responsive to the actuation of each push button, said storing means, said comparing means, and said operating means all comprise a microcomputer, and wherein said display means comprises an LCD display and associated controller connected to the microcomputer.

11. The lock of claim 1, wherein the lock is mounted on a luggage case having a latching mechanism, and said latch means includes means for inhibiting the operation of the latching mechanism when the lock is off-combination.

* * * * *